US007047877B2

(12) United States Patent
Powney et al.

(10) Patent No.: US 7,047,877 B2
(45) Date of Patent: May 23, 2006

(54) HAND-HELD DEVICE FOR MARKING A GOLF BALL

(75) Inventors: Steven Powney, Windsor (CA); Bogdan Mihaescu, Windsor (CA)

(73) Assignee: Durbar Holdings Inc., Windsor (CA)

( * ) Notice: Subject to any disclaimer, the term of this patent is extended or adjusted under 35 U.S.C. 154(b) by 0 days.

(21) Appl. No.: 11/045,139

(22) Filed: Jan. 31, 2005

(Under 37 CFR 1.47)

(65) Prior Publication Data

US 2005/0204938 A1 Sep. 22, 2005

Related U.S. Application Data

(60) Provisional application No. 60/553,545, filed on Mar. 17, 2004.

(51) Int. Cl.
*B41J 17/00* (2006.01)

(52) U.S. Cl. ..... 101/35; 101/DIG. 40

(58) Field of Classification Search ..... 101/35, 101/DIG. 40; 269/3, 6; 29/268, 270
See application file for complete search history.

(56) References Cited

U.S. PATENT DOCUMENTS

| | | | | | |
|---|---|---|---|---|---|
| 849,600 | A * | 4/1907 | Cory | ..... | 101/4 |
| 1,281,063 | A * | 10/1918 | Pearson | ..... | 101/41 |
| 1,537,685 | A * | 5/1925 | Ladd | ..... | 101/4 |
| 1,814,170 | A * | 7/1931 | Long | ..... | 101/35 |
| 4,546,644 | A * | 10/1985 | Beny et al. | ..... | 73/65.02 |
| 6,829,989 | B1 * | 12/2004 | Chudy | ..... | 101/35 |

* cited by examiner

*Primary Examiner*—John Barlow
*Assistant Examiner*—Marissa Ferguson
(74) *Attorney, Agent, or Firm*—Matthew M. Roy; Ogilvy Renault, LLP

(57) ABSTRACT

A hand-held device for marking a golf ball has a handle and first and second forks (or arms) for holding the golf ball between the forks. The golf ball is held between a ball-receiving portion of the first fork and a rubber gripper rotationally mounted to the second fork which can be manually turned to rotate the ball between the forks. A spring-loaded marker presses its tip against the ball to inscribe a line as the ball rotates against the tip of the marker. In operation, the device can circumscribe a continuous line around the circumference of the ball without resetting the ball, as well as any arc less than 360 degrees. By resetting the ball perpendicularly after a first arc is inscribed, a second, intersecting arc can be inscribed to define a cross in two easy steps.

20 Claims, 5 Drawing Sheets

HAND-HELD DEVICE FOR MARKING A GOLF BALL

CROSS-REFERENCE TO RELATED APPLICATIONS

This application claims the benefit of priority under 35 U.S.C. 119(e) from U.S. Provisional Patent Application Ser. No. 60/553,545 which was filed on Mar. 17, 2004 and having the same title as the present application.

TECHNICAL FIELD

The present invention relates generally to golf equipment and accessories and, in particular, to a device for marking a golf ball.

BACKGROUND OF THE INVENTION

In the increasingly popular sport of golf, putting the ball into the hole is one of the most difficult aspects of the game. Indeed, to hone one's putting skills, a player must typically practice for many hours on a putting green. One effective approach to practicing the art of putting is to mark a clearly visible line around the circumference of a golf ball. A circumferential line around a golf ball is useful in two regards. First, a circumferential line helps the player to align the putt toward the hole. Second, the circumferential line also helps the player to observe any spin or bounce on the ball that results from a poor stroke. Furthermore, golfers sometimes will want to inscribe an arc or a cross (consisting of intersecting arcs) on a golf ball for a full stroke for a longer shot than a putt.

Since it is nearly impossible to circumscribe a perfectly circular line around a golf ball, or to inscribe a perfect cross, using only a marker or pen, golf enthusiasts and accessory designers have devised a variety of devices and apparatuses for marking or circumscribing a line around the circumference of a golf ball.

For example, in U.S. Pat. No. 6,324,971 which issued on Dec. 4, 2001 to Urban entitled GOLF BALL MARKING DEVICE AND GOLF PUTTING ALIGNMENT SYSTEM, the golf ball is rested atop a cup-like holder (with an optional support peg) and a line is inscribed around the circumference of the ball. To mark the ball, the player must hold the ball and the holder with one hand while marking the ball with a marker in his other hand. However, circumscribing the entire circumference of the ball in one continuous line is very awkward and therefore the player must turn the ball and holder to continue the line around the ball.

In U.S. Pat. No. 6,453,807 which issued on Sep. 24, 2002 to Ramey entitled GOLF BALL MARKING TOOL, the golf ball is held in a cup-like holder at one of various depths permitting circular lines of various diameters to be inscribed. Like the Urban device, the downside of this Ramey device is that a continuous circumscribing of the ball (in one movement) is very awkward, if not impossible.

In U.S. Pat. No. 6,676,544 which issued on Jan. 13, 2004 to Tyke entitled GOLF BALL MARKING GUIDE, the golf ball is held within a pivoting clamp with an arced groove therein for inscribing a line onto the golf ball. However, since the groove subtends an arc less than less 180 degrees, the device must be reclamped at least twice to permit the player to complete a fully circumscribed line.

In U.S. Pat. No. 6,216,587 which issued on Apr. 17, 2001 to Foley entitled GOLF BALL MARKING DEVICE, the golf ball is frictionally restrained within a resiliently deformable retention cavity that bends around the outside of the ball. A marker can be inserted through a groove in the retention cavity for marking a line on the ball. However, as was the case with the Tyke device, the arc of the groove is limited, thus requiring the player to release the ball, to relocate it and to secure the ball anew.

Also known in the industry is a ball marker clip sold under the trademark Line M Up. This concave plastic device clips onto the ball and has an arced groove for marking the ball. However, to mark a complete line around the circumference, the ball must be removed and replaced three times.

Finally, there is also a ball sweet spot finder sold under the trademark Check-GO. This battery-powered device has an electric motor for rotating the ball. The device has a side access port permitting a user to manually hold a marker pen against the rotating ball. However, because of its electric motor, gears, and its need for batteries, this device is unnecessarily expensive, bulky and heavy and is not amenable to being carried around in a golf bag. Furthermore, to operate the device properly, a flat surface is required, which is not always readily available at a putting green or on a golf course.

Therefore, the prior art fails to provide a purely mechanical device that would enable a user, without holding the marker, to inscribe an arc, a cross or a continuous line around the circumference of a golf ball. Such a device would therefore be highly desirable.

SUMMARY OF THE INVENTION

It is therefore an object of the present invention to provide a device for marking a golf ball that overcomes the deficiencies of the prior art by permitting a golfer to inscribe an arc or a cross on a golf ball or, alternatively, to circumscribe a continuous line around the circumference of a golf ball, in all cases without having to hold the marker.

In general, and as will be elaborated below, the invention thus provides a hand-held device for marking a golf ball, the device comprising a handle; a first fork extending from the handle, the first fork having a first ball-receiving portion for engaging the golf ball; a second fork extending from the handle, the second fork having a second ball-receiving portion for engaging the golf ball; a rotatable gripper rotationally mounted to the second fork for frictionally engaging and rotating the golf ball; and a marker connected to the handle for marking the golf ball when the golf ball is rotated by the gripper.

The invention further provides a hand-held device for marking a golf ball, the device comprising a body defining a handle; a first arm extending from the body, the first arm having a first ball-receiving means; a second arm extending from the body, the second arm having a second ball-receiving means, the first and second ball-receiving means being spaced apart to hold a golf ball between the first and second ball-receiving means, the second ball-receiving means including a rotatable gripper for frictionally engaging and rotating the golf ball; and a marker connected to the body for circumscribing a continuous circumferential line on the golf ball when the golf ball is rotated by the gripper.

The hand-held device enables a user to mark a golf ball accurately, easily and simply. The hand-held device enables a golfer to circumscribe a continuous circumferential line around a golf ball or, alternatively, to inscribe an arc or a cross. In other words, after inscribing a first arc, the ball can be reset perpendicular to the first arc in order to inscribe a second intersecting arc, thus defining a cross. As is known by golfers, different types of markings are useful for practicing different types of strokes. For example, a circumferential line might be used circumscribed on a ball to practice putting, while a cross might be inscribed on a ball to practice lining up a full stroke for longer shots than a putt. As will be appreciated by golfers, any type of mark can be for any type of stroke, depending on a golfer's personal preferences.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF PREFERRED EMBODIMENTS

Figure 1:
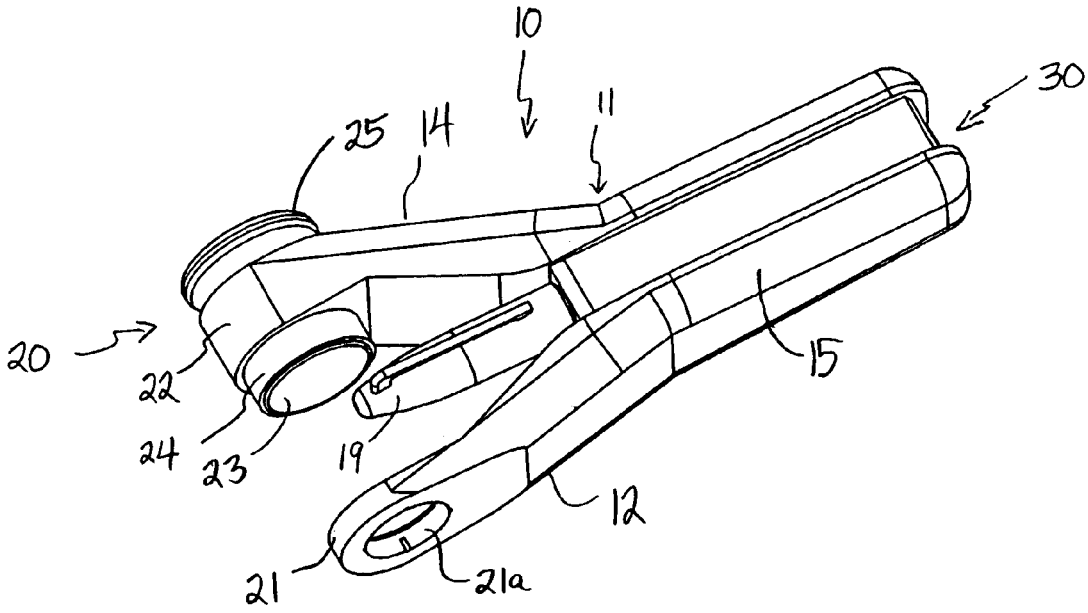
FIG. 1 is an isometric perspective view of a hand-held device for marking a golf ball in accordance with an embodiment of the present invention.
Figure 2:
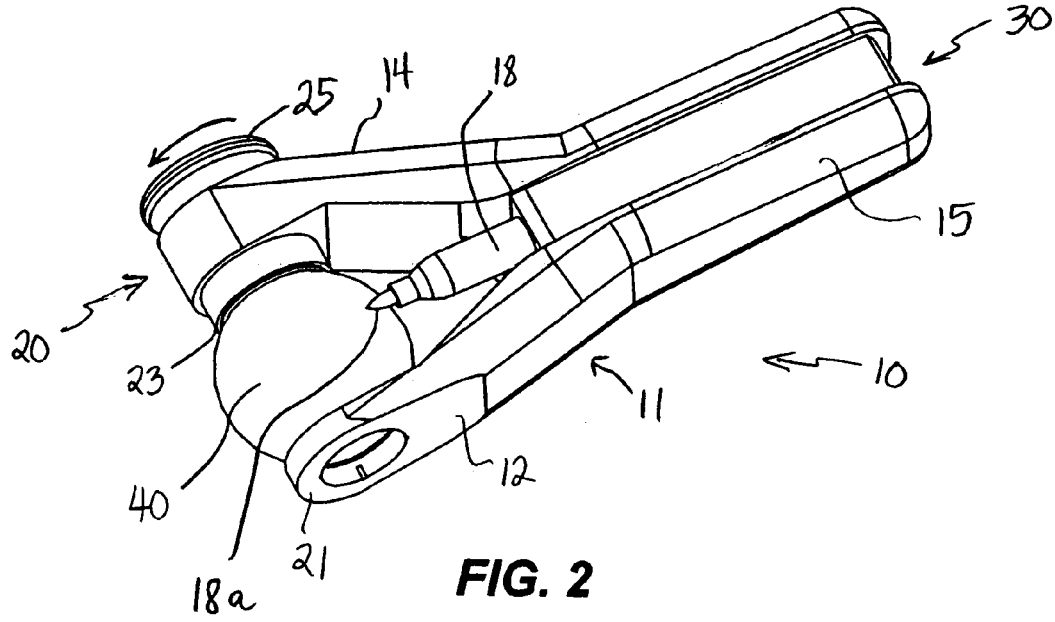
FIG. 2 is an isometric perspective view of the device shown in FIG. 1 with its marker uncapped and a golf ball loaded for marking.

FIGS. 1 and 2 illustrate a hand-held device for marking a golf ball, the device being generally designated by reference numeral 10. The device 10 has a generally Y-shaped body 11 including a handle 15 that is sized and shaped to permit a golfer to hold the device comfortably in one hand.

As shown in FIGS. 1 and 2, the device has a first fork (or first "arm") 12 extending from the handle 15 as well as a second fork (or second "arm") 14 extending from the handle 15. The first and second forks (arms) 12, 14 are angled outwardly with respect to the handle 15 to accommodate a golf ball 40 between the forks. The first fork 12 has a ball-receiving portion 21 preferably having a circular aperture 21*a* for receiving a portion of the golf ball 40. The second fork 14 has a gripper assembly 20 for frictionally engaging and rotating the golf ball, as will be explained in greater detail below. Integrated within the handle 15 is a marker holder 30. The marker holder 30 is preferably flush with the handle 15 and has a space thereon for inscribing a trademark, product name or company logo, if desired. The marker holder 30 houses a marker 18 having a removable cap 19. The marker preferably has a felt tip 18*a*, although other types of writing instruments may be used provided they are able to inscribe a continuous, visible line on the dimpled surface of the golf ball.

FIG. 1 illustrates the device in its "unloaded state" in which the marker 18 is covered with its cap 19 whereas FIG. 2 illustrates the device in its "loaded state" in which the cap 19 is removed from the marker 18 so that the marker tip 18*a* contacts the dimpled surface of the golf ball when the ball is snugly engaged between the forks. To circumscribe a continuous line fully around the circumference of the golf ball, a golfer turns a rotation wheel 25 preferably in the direction indicated by the curved arrow in FIG. 2. The rotation wheel is operatively engaged with a gripper 23 via a gripper holder 24. The gripper frictionally grips and rotates the golf ball between the forks. The tip 18*a* of the marker 18 thus circumscribes a continuous line around the circumference of the ball. If the golfer wishes, he or she may circumscribe a second line on the ball. This is accomplished by resetting the marked ball with the first circumscribed line perpendicular to the marker and again turning the rotation wheel to rotate the golf ball against the marker tip.

Figure 3:
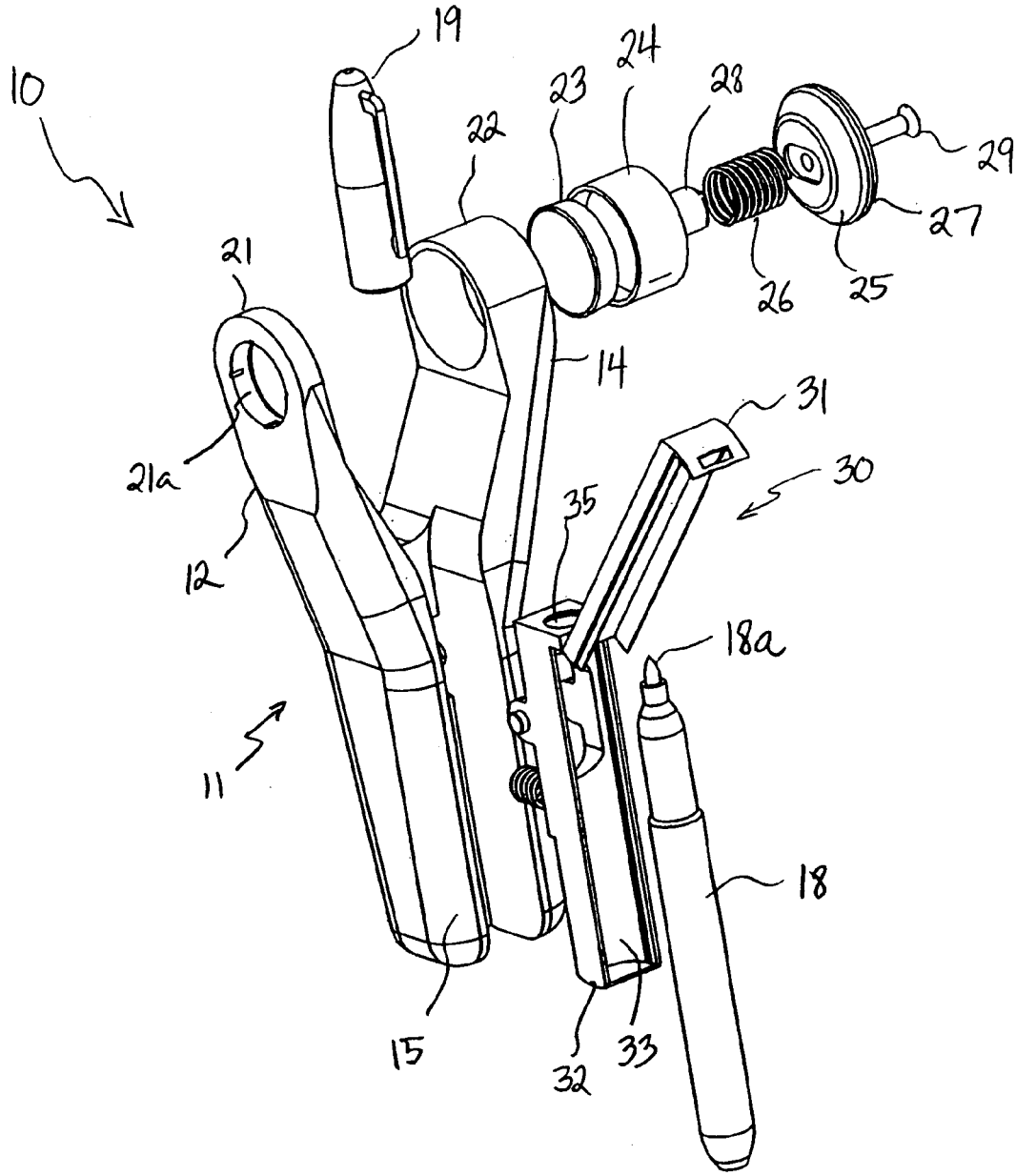
FIG. 3 is an exploded view of the device of FIG. 1 as viewed from a left-side perspective.
Figure 4:
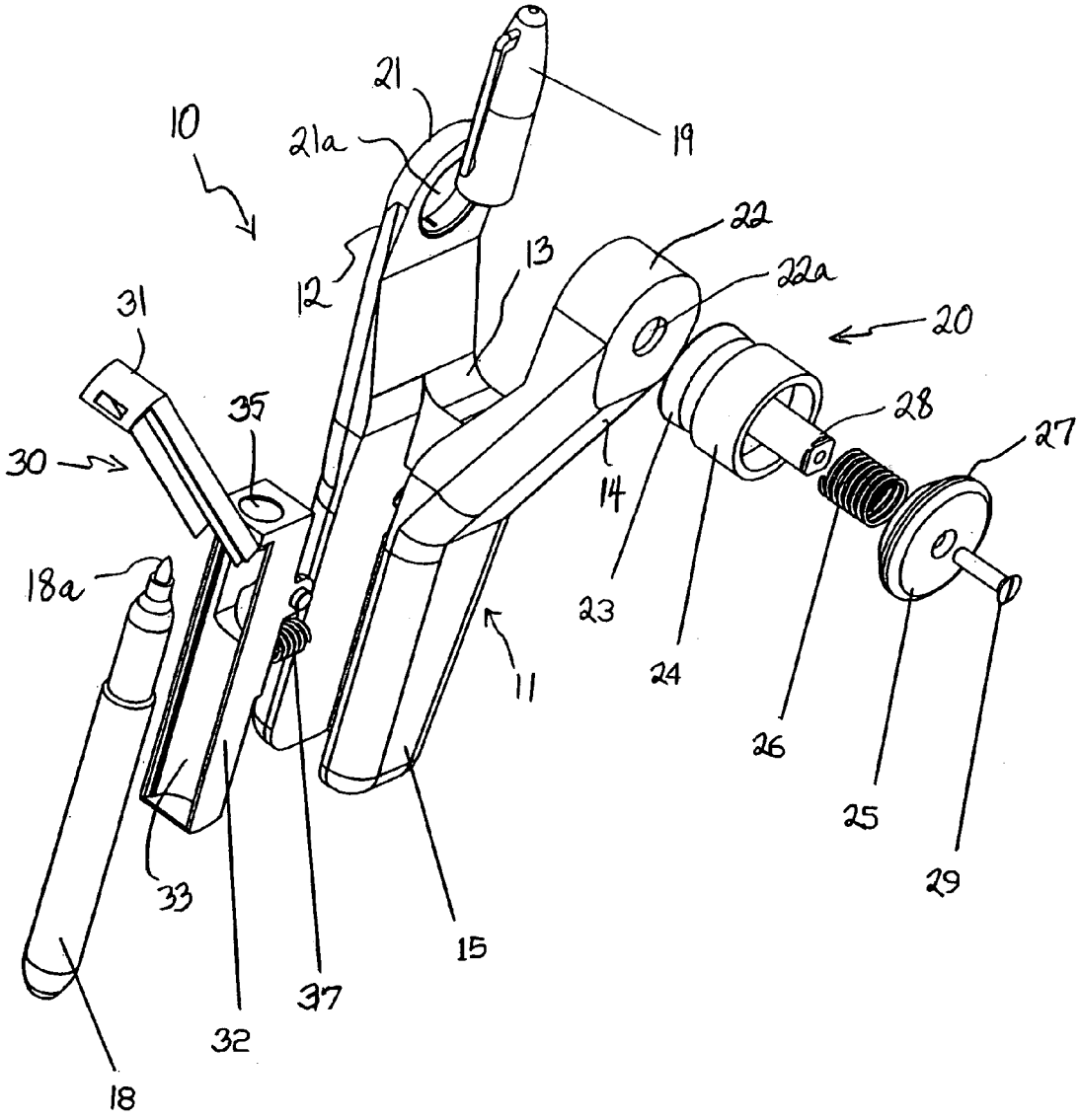
FIG. 4 is an exploded view of the device of FIG. 1 as viewed from a right-side perspective.

FIGS. 3 and 4 are exploded views of the device 10. The gripper assembly 20 has a gripper 23 which is generally a bowl-shaped receptacle. The gripper is made of an elastomeric material such as rubber to provide high-friction engagement with the golf ball. The gripper assembly 20 has a gripper holder 24, preferable made of plastic for holding the gripper. The gripper holder has a shaft 28 over which a spring 26 is coiled. The shaft is tapped with internal threads. A rotation wheel 25 is fastened to the gripper holder (and thus to the gripper) using a threaded fastener 29, which is preferably a screw. The outer surface of the rotation wheel 25 is countersunk or counterbored so that the head of the screw 29 is below the surface of the rotation wheel 25 when assembled.

The rotation wheel 25 has a periphery 27 with a high-friction surface finish. The high-friction surface finish may be a coating or the periphery 25 may be roughened by knurling or grooving. A high-friction surface finish on the periphery helps a golfer turn the rotation wheel.

As shown in FIGS. 3 and 4, the gripper assembly is mounted to the second fork in the following manner. The gripper 23 and the gripper holder 24 are housed in a circular recess 22 in the second fork 14. The circular recess 22 has an aperture 22*a* through which the shaft 28 extends. The spring is coiled over the shaft and is compressed between the inside wall of the circular recess 22 and the gripper holder 24. The spring therefore flexibly biases the gripper against the golf ball, thereby snugly restraining the golf ball between the gripper and the ball-receiving portion 21 of the first fork 12.

As shown in FIGS. 3 and 4, the marker holder 30 has a pivoting lid 31 hinged to a rectangular body 32 for releasably securing the marker 18 in a rectangular cavity 33. The marker can be replaced when it runs out of ink or when a different color marker is desired (for marking different color balls). At the top of the marker holder 30 is a circular aperture 35 through which the top of the marker 18 is extended. A spring 37 is connected between the marker holder 30 and the handle 15. The spring 37 flexibly biases the marker holder 30 and the tip 18*a* of the marker 18 against the golf ball 40 to ensure firm and continuous contact between the tip 18*a* of the marker 18 and the golf ball 40. An optional removable cap 19 covers the tip 18*a* when the device 10 is not in use.

Figure 5:
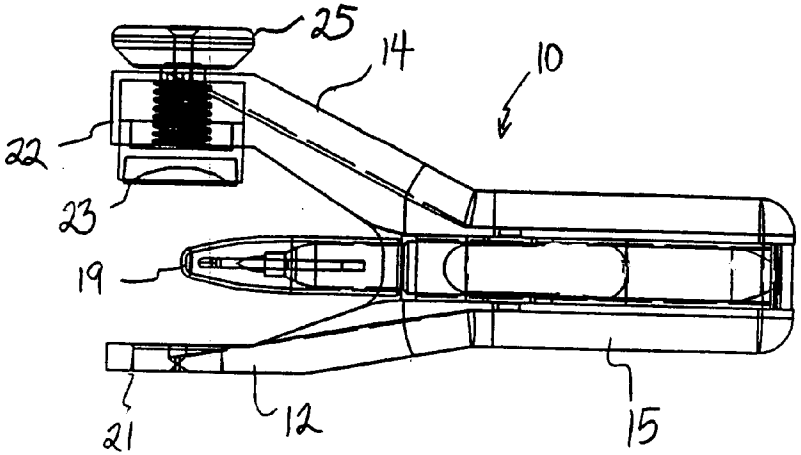
FIG. 5 is a top plan view of the device of FIG. 1.

FIG. 5 is a top plan view of the device 10. As shown in this figure, the second fork 14 is angled outwardly at a greater angle than the first fork 12 so that the device is asymmetric about a longitudinal axis defined by the marker. FIG. 5 also shows that the ball-receiving portion and the gripper are substantially in alignment so that the golf ball is securely restrained between the forks.

Figure 6:
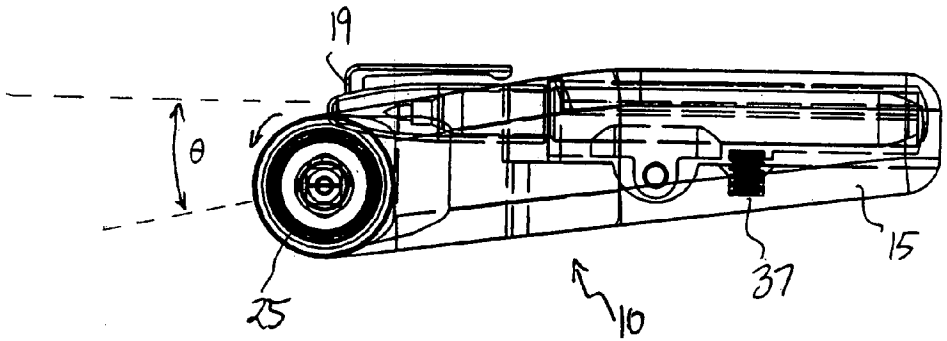
FIG. 6 is a side elevation view of the device of FIG. 1.

FIG. 6 is a side elevation view of the device 10. This figure illustrates the declination of the first and second forks with respect to the longitudinal axis defined by the marker. The angle of declination is indicated in this figure by angle theta, $\theta$. Due to the declination of the forks, the tip of the marker contacts the outer surface of the golf ball. A line is marked on the golf ball by preferably rotating the golf ball in the direction of the curved arrow in FIG. 6. Rotating the golf ball in this direction ensures that the felt tip of the marker strokes the ball away from the marker, which is better for the tip. Rotating the golf ball away from the marker is analogous to drawing a line by dragging the pen over paper rather than pushing the pen over paper which tends to flatten the tip and to produce an uneven line quality.

Figure 7:
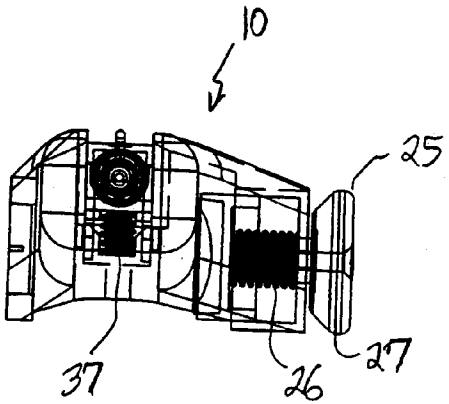
FIG. 7 is a rear elevation view of the device of FIG. 1.

Shown in FIG. 7 is a rear elevation view of the device 10. FIG. 7 shows the orthogonal orientation of the two springs 26, 37 described above. The spring 37 flexibly biases the marker holder and the marker against the golf ball to ensure firm contact between the tip of the marker and the golf ball. The spring constant of the spring 37 is selected to ensure firm contact between the tip of the marker and the golf ball without deforming the tip.

As illustrated in FIG. 7, the spring 26 flexibly biases the gripper against the golf ball, ensuring that the gripper frictionally engages the golf ball with sufficient force to enable the gripper to rotate the golf ball without any significant slippage. The spring constant of the spring 26 is selected to provide sufficient grip between the gripper and the golf ball while still permitting a golf ball to be easily inserted between the gripper and the ball-receiving portion of the first fork. In other words, the spring 26 must have a spring constant such that the spring will readily compress when a golf ball is being lodged between the gripper and the ball-receiving portion and will then expand to hold the golf ball snugly between the gripper and the ball-receiving portion of the first fork. On completion of a 360-degree rotation of the golf ball, the golf ball may be removed by pulling outwardly on the rotation wheel to release the spring pressure on the ball.

Figure 8:
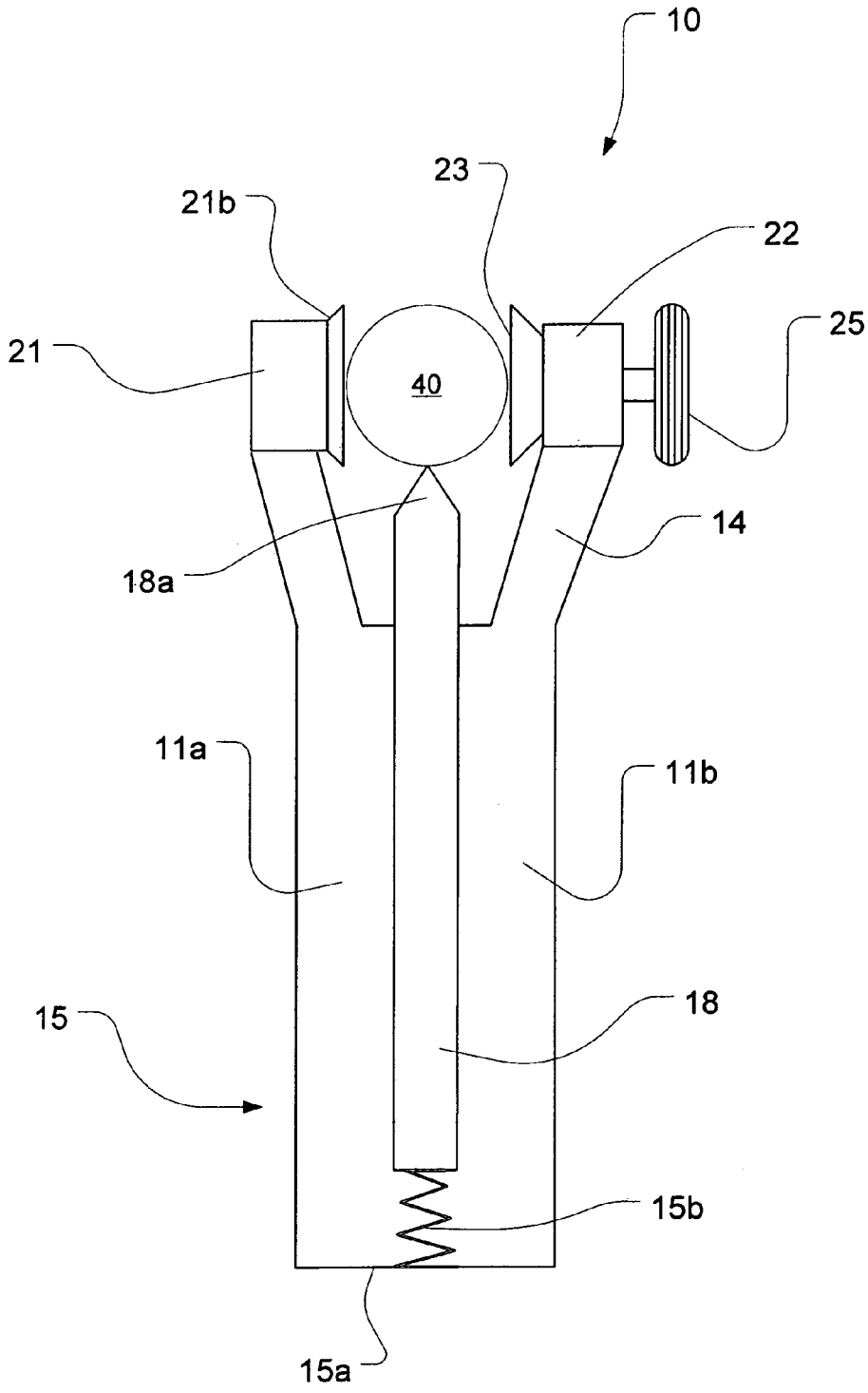
FIG. 8 is a top plan view of the device in accordance with a preferred embodiment of the present invention.

A preferred embodiment of the hand-held device for marking a golf ball in accordance with the present invention is illustrated in FIG. 8. In this second preferred embodiment, the device 10 is formed of two mating plastic molded halves 11*a* and 11*b* which come together to form a Y-shaped body having a handle 15 shaped and sized to ergonomically receive a human hand. The mating halves 11*a*, 11*b* of the Y-shaped body also define a central bore sized and shaped to receive a pen or marker 18. The marker 18 is biased against the golf ball 40 by a spring 15*b* which is supported on a bottom inside surface 15*a* of the handle 15. The spring 15*b* presses the tip 18*a* of the marker 18 against the golf ball 40 to ensure that a clear line is circumscribed when the device is operated. In the preferred embodiment, the spring 15*b* is bonded directly to a bottom end of the pen (or marker) and the pen/spring subassembly is slid into the bore formed by the mating halves of the body. Alternatively, the spring 15*b* can be bonded to the bottom inside surface of the body. In either variant, the marker can be slid out of the handle for periodic replacement. In the preferred embodiment, the marker is not secured within the bore; nevertheless, the pen will not slip out of the bore in the handle in normal use.

The hand-held device for marking a golf ball shown in FIG. 8 is operated by turning the rotation wheel 25 which causes the rubber gripper 23 to rotate the golf ball 40, as was described above. It should be noted that in this preferred embodiment, the rotation wheel is neither grooved nor knurled, as it was in the previous embodiment, but such a finishing could, of course, be optionally applied.

As was the case with the previous embodiment, the golf ball 40 is held between the gripper on one fork (or arm) and the ball-receiving portion 21 of the other fork (or arm). In this embodiment, as illustrated in FIG. 8, the ball-receiving portion 21 further includes a ball receptacle 21*b* which can be a rubber bowl-shaped receptacle which facilitates holding of the ball between the forks/arms. Each fork or arm could further include a small notch or alignment marker (that could be integrally molded into the body of the device). The alignment marker would enable a golfer to realign the ball perpendicular to a first arc in order to inscribe a second, intersecting arc to thus define a cross.

The thickness of the line made by the marker on the golf ball will depend on the type of marker and the force exerted on the marker against the surface of the golf ball. The thickness of the line inscribed by the marker on the golf ball is thus a function of the spring rate of the spring 15*b*. In other words, by changing the spring rate, the line thickness can be modified. In the preferred embodiment, the spring 15*b* has a nonlinear spring rate so that the marker can be "pre-loaded" against the spring 15*b* with a varying degree of force. Thus, the thickness of the line inscribed on the golf ball can be varied by adjusting the marker's position against the spring 15*b*.

The advantages of this marking device vis-á-vis the prior art are numerous. First of all, the device is hand-held and easily portable to golf courses and putting greens. Since a flat surface is not required to operate the device, balls can be marked while standing, walking or riding in a golf cart. Secondly, the entire device is mechanical and thus no battery or electric power is required. Thirdly, the device permits a continuous line to be marked around the ball without having to reset the ball in the device, which ensures one quick and accurate circumferential line. Fourthly, since the marker is an integral part of the device, the marker cannot be lost or separated from the device. Fifthly, the marking of balls with this device is highly precise and repeatable since the inscribing of the line is done mechanically rather than manually. In other words, the user does not have to hold the marker or pen to inscribe a mark on the ball. Sixthly, the device is versatile in that it is not only capable of circumscribing a line around the ball but also of marking arcs less than 360 degrees. In other words, the device can be used to inscribe an arc or alternatively a cross can be inscribed by inscribing a first arc, resetting the ball perpendicularly, and then inscribing a second, intersecting arc. Seventhly, Yet further advantages and benefits will become apparent to a person of ordinary skill in the art upon review of the present specification.

Although the marking device described and illustrated herein represents the best mode of implementing this invention known to the applicants, persons of skill in the art will appreciate that variations and modifications to the configuration and to the components shown may be made without departing from the scope of the invention. The embodiment of the invention described above is therefore intended to be exemplary only. The scope of the invention is intended to be limited solely by the scope of the appended claims.

What is claimed is:

1. A hand-held device for marking a golf ball, the device comprising:

a handle;

a first fork extending from the handle, the first fork having a first ball-receiving portion for engaging the golf ball;

a second fork extending from the handle, the second fork having a second ball-receiving portion for engaging the golf ball;

a rotatable gripper rotationally mounted to the second fork for frictionally engaging after the golf ball has been engaged by both the first and second ball receiving portions and rotating the golf ball; and a marker connected to the handle for marking the golf ball when the golf ball is rotated by the gripper.

2. The device as claimed in claim 1 further comprising a rotation wheel connected to the gripper for rotating the gripper.

3. The device as claimed in claim 1 further comprising a marker holder affixed to the handle for securing the marker.

4. The device as claimed in claim 3 wherein the marker holder is integrated within the handle.

5. The device as claimed in claim 3 wherein the marker holder comprises a pivoting lid for releasably securing the marker in the marker holder.

6. The device as claimed in claim 1 further comprising a spring within the handle for biasing the marker against the golf ball.

7. The device as claimed in claim 1 wherein the first ball-receiving portion of the first fork is a circular aperture.

8. The device as claimed in claim 1 wherein the gripper is a bowl-shaped receptacle.

9. The device as claimed in claim 8 wherein the gripper is elastomeric.

10. The device as claimed in claim 1 further comprising a spring for flexibly biasing the gripper against the golf ball.

11. The device as claimed in claim 1 wherein the first fork and the second fork are angled outwardly from the handle whereby the first and second forks and the handle together define a generally Y-shaped structure.

12. The device as claimed in claim 1 wherein the marker comprises a removable cap.

13. A hand-held device for marking a golf ball, the device comprising:

a body defining a handle;

a first arm extending from the body, the first arm having a first ball-receiving means;

a second arm extending from the body, the second arm having a second ball-receiving means, the first and second ball-receiving means being spaced apart to hold a golf ball between the first and second ball-receiving means, the second ball-receiving means including a rotatable gripper for frictionally engaging and rotating the golf ball; after the golf ball has been engaged by both the first and second ball receiving means and a marker connected to the body for circumscribing a continuous circumferential line on the golf ball when the golf ball is rotated by the gripper.

14. The device as claimed in claim 13 further comprising a rotation wheel connected to the gripper for rotating the gripper.

15. The device as claimed in claims 13 further comprising a marker holder connected to the handle for securing the marker.

16. The device as claimed in claim 15 wherein the marker holder is integrated flush within the handle.

17. The device as claimed in claim 15 further comprising a holder spring connected between the marker holder and the handle for flexibly biasing the marker against the golf ball.

18. The device as claimed in claim 15 wherein the marker holder further comprises a pivoting lid for releasably securing the marker in the marker holder.

19. The device as claimed in claim 13 wherein the gripper is a bowl-shaped elastomeric receptacle.

20. The device as claimed in claim 13 further comprising a spring connected between the second arm and the gripper for flexibly biasing the gripper against the golf ball.

* * * * *